United States Patent [19]

Strasser

[11] Patent Number: 4,967,564

[45] Date of Patent: Nov. 6, 1990

[54] CRYOSTATIC TEMPERATURE REGULATOR WITH A LIQUID NITROGEN BATH

[75] Inventor: Wilhelm Strasser, Bergisch Gladbach, Fed. Rep. of Germany

[73] Assignee: Leybold Aktiengesellschaft, Fed. Rep. of Germany

[21] Appl. No.: 426,166

[22] Filed: Oct. 25, 1989

[51] Int. Cl.[5] ..... F17C 5/02

[52] U.S. Cl. ..... 62/47.1; 62/383; 62/457.9

[58] Field of Search ..... 62/47.1, 383, 457.9, 62/51.1

[56] References Cited

U.S. PATENT DOCUMENTS

| | | | |
|---|---|---|---|
| 2,784,560 | 3/1957 | Johnson, Jr. | 62/47.1 |
| 4,279,127 | 7/1981 | Longsworth | 62/51.3 |
| 4,689,970 | 9/1987 | Ohguma et al. | 62/383 |

*Primary Examiner*—Ronald C. Capossela

*Attorney, Agent, or Firm*—Hill, Van Santen, Steadman & Simpson

[57] ABSTRACT

A cryostatic temperature regulator having a liquid nitrogen bath. The cryostatic temperature regulator is equipped with a cold head of a refrigerator which is coupled to the cover of the housing of the cryostatic temperature regulator in order to avoid gas losses.

18 Claims, 2 Drawing Sheets

CRYOSTATIC TEMPERATURE REGULATOR WITH A LIQUID NITROGEN BATH

BACKGROUND OF THE INVENTION

The present invention provides a cryostatic temperature regulator having a liquid nitrogen bath, a container, a cover and at least one downwardly directed cold head of a refrigerator for the recondensation of evaporating liquid nitrogen.

Cryostatic temperature regulators are devices for setting and maintaining low temperatures. In a cryostatic bath, one type of cryostatic temperature regulator, the temperature is set and maintained at the boiling point of the refrigerant. For example, the boiling point of liquid nitrogen ($LN_2$) is 77K at ambient pressure. However, by utilizing an over-pressure or under-pressure in the bath, the temperature of the boiling point can be modified accordingly. A nitrogen bath cryostat, however, is typically operated at approximately atmospheric pressure.

The utilization of a cryostatic temperature regulator to maintain temperatures of approximately 77K is of increasing significance. For example, in order to achieve higher power densities, electro-magnets, circuits of computers, and the like are cooled to temperatures of approximately 77K. Additionally, superconductors, with transition temperatures above 80K, can also be operated at the boiling temperature of $LN_2$.

However, due to the boiling of the nitrogen, in known $LN_2$ bath cryostats, a constant gas loss, which is dependent on the load of the bath, occurs.

SUMMARY OF THE INVENTION

The present invention provides a cryostatic temperature regulator, having a liquid nitrogen ($LN_2$) bath, that avoids gas losses.

To this end, the present invention provides a cryostatic temperature regulator comprising a $LN_2$ bath, a container for the $LN_2$ bath, a cover for the container, and at least one downwardly directed cold head of a refrigerator for the recondensation of evaporating nitrogen, the cold head being coupled to the cover.

In an embodiment of the present invention, the downwardly directed cold head has a cold end which is either immersed in the $LN_2$ bath or is positioned above the $LN_2$ bath.

In an embodiment of the present invention, the cover comprises a throughflange floor and a hood, and the downwardly directed cold head is secured at the throughflange floor.

In an embodiment of the present invention, the height of the cold head is within the cryostatic temperature regulator, with respect to the surface of the bath, is adjustable.

In an embodiment of the present invention, a hood, a compression spring and an accordion bellows form means for adjusting the height of the cold head; these parts together with a flange, which is secured to the cold head and is arranged so that it is displaceable in the hood, form two closed spaces.

In an embodiment of the present invention, the cold head operates according to the Gifford/McMahon principle, and a gas control is located outside the cryostatic temperature regulator.

In an embodiment of the present invention, a heater is located at the cold end of the cold head.

In an embodiment of the present invention, means are provided for enlarging the surface of the cold head. The surface enlargement means can be constructed, in an embodiment, from a compound chosen from the group consisting of extruded aluminum and copper.

In an embodiment of the present invention, the container and the cover are equipped with flanges which are connected to one another in a gas-tight manner through a hose section. In a further embodiment of the present invention, a plurality of connector nozzles are attached to the hose section or to the hose section and the cryostatic temperature regulator.

Additional features and advantages of the present invention are described in, and will be apparent from, the detailed description of the presently preferred embodiments and the drawings.

DETAILED DESCRIPTION OF THE PRESENT PREFERRED EMBODIMENT

Figure 1:
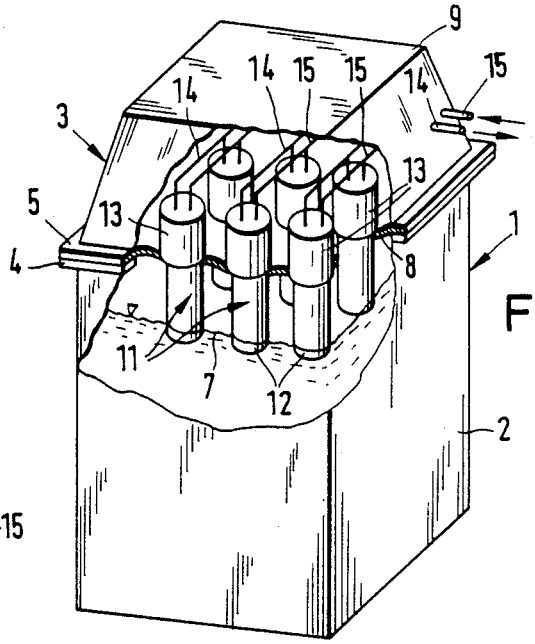
FIG. 1 illustrates an embodiment of the cryostatic temperature regulator of the present invention with parts broken away.

The present invention provides a cryostatic temperature regulator, having a liquid nitrogen ($LN_2$) bath, that prevents the loss of nitrogen gas. To this end, the regulator includes a container with a cover and at least one downwardly directed cold head of a refrigerator for the recondensation of evaporating $LN_2$.

A refrigerator is a cryogenerator, or a low temperature refrigerating installation, having a cold head in which a thermodynamic cyclic process is carried out (see, for example, U.S. Pat. No. 2,906,101). In a single stage cold head of a refrigerator, a cylindrical chamber is provided which has a displacer that moves back and forth therein. The chamber is alternately connected, in a set manner, to a high-pressure gas reservoir and to a low-pressure gas reservoir. This allows a thermodynamic cyclic process, for example, a Sterling process or a Gifford/McMahon process, to be carried out during the reciprocating motion of the displacer. As a result thereof, heat is withdrawn from one of the two face sides of the chamber. Temperatures of approximately 40K can be produced with this type of single-stage cold head utilizing helium as a working gas.

By utilizing one or more refrigerator cold heads arranged inside the container of a bath cryostat, recondensation of the evaporating nitrogen can be achieved. The cold end of the cold head can be positioned directly above the $LN_2$ bath or immersed therein. One of the advantages of this arrangement is that since the cold end can be directly positioned in the fluid phase or the gas phase of the $LN_2$, the effect of the cold end is not deteriorated by transmission elements.

When the cold heads are positioned directly above the surface of the $LN_2$ bath, the cold heads form condensation surfaces wherein condensed nitrogen can drip back into the bath. In this case, the surface of these cold heads can be enlarged through the utilization of radial metal sheet sections.

When the cold ends of the cold heads are immersed in the bath, there is a direct contact of the cold ends with the nitrogen to be cooled. The result is that an overall lowering of the temperature occurs. Nitrogen, evaporating from the bath, condenses either at the cold surfaces positioned above the surface of the bath or at the surface of the bath itself.

Pursuant to the present invention, preferably, the height of the cold heads is adjustable, either individually or in some combination. This allows one to be able to set the refrigerating capacity. To this end, the refrigerating capacity can be set either by lifting the individual cold heads and removing them out of operation, by varying the immersion depth of the individual cold heads, or by varying the immersion depth of a plurality of cold heads. For example, when the heat load on the bath rises, the increase in the refrigerating capacity that is required, can be achieved by increasing the immersion depth of the cold heads.

This procedure can be automatically controlled, for example, dependent on the pressure in the cryostat. In this regard, as the amount of evaporating nitrogen increases, due to the rise of the bath load, the pressure in the bath increases. The immersion depth of the cold heads can be controlled in the bath through such a pressure change so that the pressure remains essentially constant. It should also be noted that as a further consequence of the adjustability of the height of the cold heads of the present invention, a matching of the cold-producing surfaces to the level of the $LN_2$ bath is also possible.

Referring now to the figures, FIG. 1 illustrates an embodiment of the cryostatic temperature regulator 1 of the present invention. The regulator 1 comprises a container 2 having a cover 3. Preferably, the double-wall container 2 and cover 3 are constructed from materials having poor thermal conductivity and are vacuum insulated. The container 2 and the cover 3 each include flanges 4 and 5 that press against one another during operation of the cryostatic temperature regulator. The flanges 4 and 5 are sealed with a sealing ring 6 (illustrated in FIG. 6) and clamps (not shown).

Figure 5:
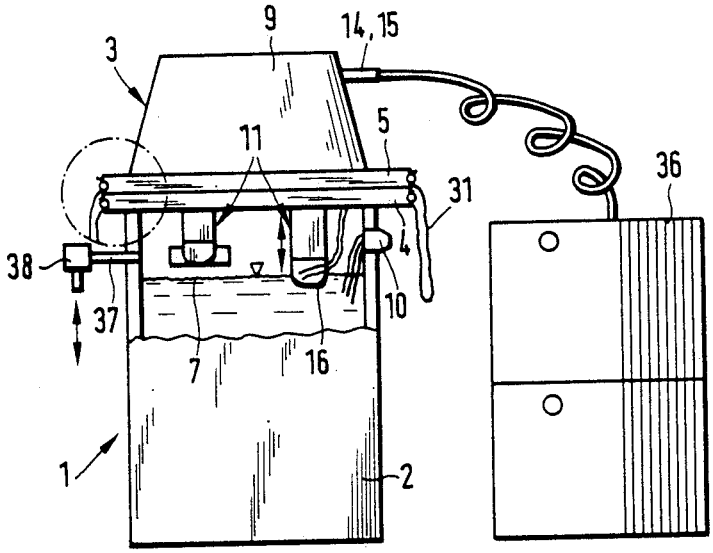
FIG. 5 illustrates a perspective view of an embodiment of the cryostatic temperature regulator.
Figure 7:
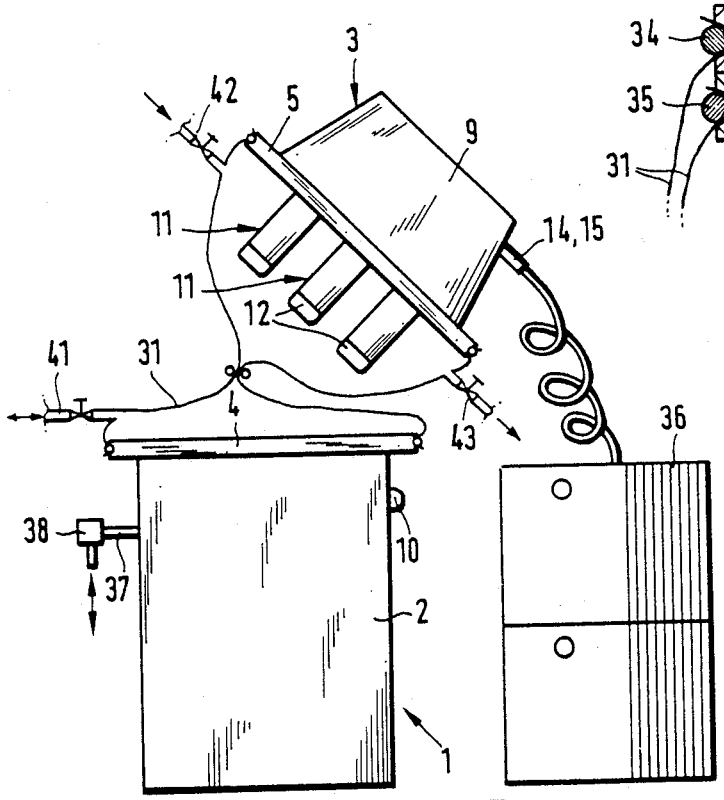
FIG. 7 illustrates a perspective view of the cryostatic temperature regulator of claim 5 illustrating possible refrigerator replacement.

A $LN_2$ bath 7 is located inside the container 2. Component parts (not shown) that are to be cooled, are located within the $LN_2$ bath. As illustrated in FIGS. 5 and 7, the container 2 includes a current bushing 10.

The cover 3 has a throughflange floor 8 that is covered by a hood 3. The cold heads 11 are secured to the throughflange floor 8. When so situated, each of the cold heads 11 has a cold end 12 which projects into the container 2.

In the embodiment of the present invention illustrated in FIG. 1, six cold heads 11 are positioned in the throughflange floor 8 of the cover 3. As illustrated, each cold head 11 includes a gas control 13 which is located at the end opposite the cold end 12. The gas control 13 is connected to a high-pressure gas source (not shown) by a first line 14 and to a low-pressure gas source (not shown) by a second line 15. The gas source could be, for example, a working gas such as helium, which is located outside the cryostatic temperature regulator 1.

In an embodiment of the present invention, the cold heads 11 can be split and the gas controls 13 can be placed outside the cryostatic temperature regulator 1. A splitting of cold heads is disclosed in German published application No. 32 01 496. By splitting the cold heads, a smaller structural volume is provided.

Figure 2:
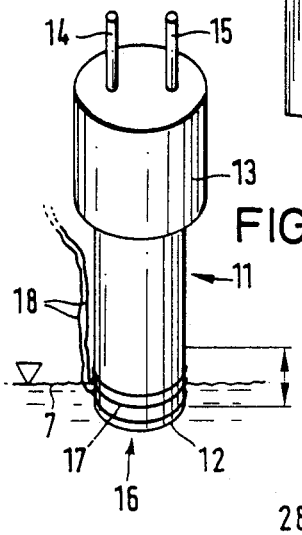
FIG. 2 illustrates a perspective view of an embodiment of the cold head of the cryostatic temperature regulator.

FIG. 2 illustrates a cold head 11 having a cold end 12 wherein an electrical heater 16, comprising a wire winding 17 and two leads 18, is attached to the cold end. By utilizing the electrical heater 16, the recondensation power in the cryostatic temperature regulator can be controlled. This procedure can be controlled so that it is dependent on the pressure in the cryostatic temperature regulator.

Figure 3:
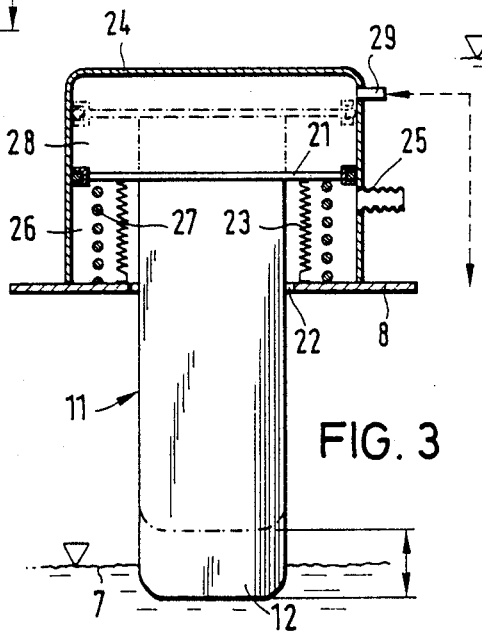
FIG. 3 illustrates a cross-sectional view of an embodiment of the cold head of the cryostatic temperature regulator.

Referring now to FIG. 3, an embodiment is illustrated wherein the cold head 11 does not include the gas control 13. The cold head 11 is secured in the throughflange floor 8 so that it is vertically adjustable. To this end, the cold head 11 contains a flange 21 located on the end opposite the cold end 12. The edge of the opening 22, in the throughflange floor 8, and the flange 21 are connected to one another by a metal accordion bellows 23, so that a tight closure of the container 2 is assured.

The cold head 11 is received within the opening 22 in the throughflange floor 8. A hood 24 is placed on the throughflange floor 8 in a vacuum-type fashion. The flange 21 is sealed in the hood 24. The flange 21, the metal accordion bellows 23, the cylindrical part of the hood 24, and the adjoining part of the throughflange floor 8 form an annular space 26. This space 26 is coupled, via a connector 25, to a means for setting the pressure (not shown). The flange 21 and thus, the cold head 11 are supported on the throughflange floor 8 by a compression spring 27. Above the flange 21, the hood 24 forms a space 28 that is in communication with the interior of the cryostatic temperature regulator 1 via a connector nozzle 29

The compression spring 27 produces an upwardly directed force which compensates for the force of the metal accordion bellows 23 and the force exerted by the pressure in the cryostatic temperature regulator. The force of the spring 27 can be overcome, and the cold head 11 lifted, by either lowering the pressure in the space 28 from the outside utilizing a vacuum pump or on the basis of the internal pressure of the cryostatic temperature regulator. Accordingly, there is also a possibility of controlling the immersion depth relative to the load of the $LN_2$ bath. For example, when an increase in the load of the $LN_2$ bath occurs, the pressure inside the cryostatic temperature regulator will then be increased. Depending on the pressure inside the cryostatic temperature regulator, the pressure in the space 28 can also be increased so that the cold head 11, through the force of the differential piston face, will be immersed deeper into the $LN_2$ bath. The refrigerating capacity is thereby increased, offsetting the increased load of the $LN_2$ bath. When the cold head 11 is not in operation, it can be lifted by introducing pressure into the annular space 26, so that the thermal conduction losses via the cold head 11 are considerably reduced.

Figure 4:
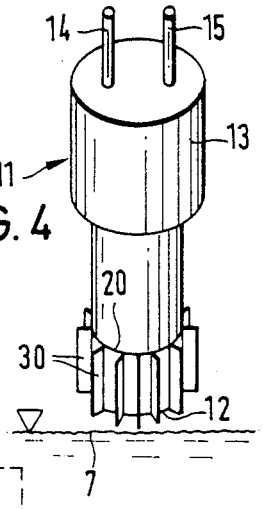
FIG. 4 illustrates a perspective view of an embodiment of the cold head of the cryostatic temperature regulator.

FIG. 4 illustrates a cold head 11 whose cold end 12 includes means for increasing the surface thereof. In the illustrated embodiment, the surface enlargement includes a ring 20 that lies against the cold head 12. The ring 20 has a sheet metal section 30, attached thereto and extending radially outward.

A cold head 11 having such an enlarged surface is very suitable for utilization immediately above the surface 7 of the $LN_2$ bath. When such a cold head 11 is located above the surface 7 of the $LN_2$ bath, any evaporating nitrogen will condense on the enlarged surface and drip back into the $LN_2$ bath. Preferably, the surface enlargement section is composed of extruded aluminum or copper.

Figure 6:
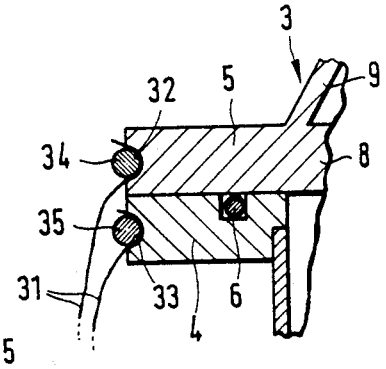
FIG. 6 illustrates a cross-sectional enlarged view of a portion of the cryostatic temperature regulator of FIG. 5.

Referring now to FIGS. 5–7, the figures illustrate how the cold heads 11, located in the cryostatic temperature regulator 1, can be replaced or can have maintenance work performed thereon. To this end, a hose section 31 is provided. The ends of the hose section 31 are secured to the flanges 4 and 5. FIG. 6 illustrates the outer edges of the flanges 4 and 5 which are equipped with channels 32 and 33 having O-rings 34 and 35. The O-rings 34 and 35 clamp the ends of the hose 31 in the channels 32 and 33 in a gas-tight manner.

FIG. 5 illustrates a partially open view of the cryostatic temperature regulator 1 of the present invention revealing for example, the two cold heads 11 of FIG. 2 and FIG. 4. As illustrated, in FIG. 5, the cold heads 11 are connected to a compressor 36 (high-pressure gas source and low-pressure gas source) by a flexible line that is received through the hood 9 of the cover 3. The cold heads 11, the flexible line, and the compressor 36 form the refrigerators which are utilized for condensation purposes.

A first connector nozzle 37, having a valve 38, discharges into the cryostatic temperature regulator 1 above the surface 7 of the $LN_2$. The hose section 31 is also equipped with a plurality of connector nozzles 41, 42, and 43 (see FIG. 7). Each of these connector nozzles 41, 42, and 43 has a valve.

Because under-pressure or over pressure prevails in the cryostatic temperature regulator 1, a pressure equalization must be produced before the cover 3 can be lifted. A pressure equalization can be achieved by letting off nitrogen gas or by admitting nitrogen gas through the first connector nozzle 37. When the cryostatic temperature regulator 1 is under an under-pressure, the pressure equalization can also be produced by evaporating a high quantity of $LN_2$ by utilizing the heater 16 on the cold head 11. The desired increase in pressure will then occur. Once the pressure equalization has been achieved, the cover 3 can be lifted. Additional nitrogen gas, for filling the hose section 31, can be supplied through one of the connector nozzles 41, 42, and 43. Once the cover 3 is lifted, the hose section 31 is pinched off with a clamp 44, roughly in the middle of the hose. The bath, located in the container 2, is then protected against the entry of air. The cover 3 can then be separated from the hose section 31.

After the required work has been performed, the cover 3 can again be connected to the upper part of the hose section 31. By utilizing the connector nozzles 42 and 43, a rinsing of the interior of the upper hose section with nitrogen can be performed. It is thereby possible to refrigerate the cold heads 11 in a nitrogen atmosphere. Contamination due to atmospheric humidity and oxygen, is avoided utilizing the procedure described above.

It should be understood that at various changes and modifications to the presently preferred embodiments described herein will be apparent to those skilled in the art. Such changes and modifications can be made without departing from the sphere and scope of the present invention and without diminishing its attendant advantages. It is therefore intended that such changes and modifications be covered by the appended claims.

I claim as my invention:

1. A cryostatic temperature regulator comprising:
a container for containing a bath, the container including a cover, and at least one downwardly extending cold head of a refrigerator for the recondensation of evaporating nitrogen, the cold head being coupled to the cover; and
means for adjusting the height of the cold head, the means including a cap, a compression spring, and an accordion bellows.

2. A cryostatic temperature regulator comprising:
a container for containing a bath, the container including a cover, and at least one downwardly extending cold head of a refrigerator for the recondensation of evaporating nitrogen, the cold head being coupled to the cover; and
a heater located in a region of a cold end of the cold head.

3. A cryostatic temperature regulator comprising:
a container for containing a bath, the container including a cover, and at least one downwardly extending cold head of a refrigerator for the recondensation of evaporating nitrogen, the cold head being coupled to the cover; and
a first flange attached to the container and a second flange attached to the cover, the first flange being connected to the second flange in a gas-tight manner via a hose section.

4. The cryostatic temperature regulator of claims 1, 2, or 3 wherein the cold head includes a cold end that is immersed in the liquid nitrogen bath.

5. The cryostatic temperature regulator of claims 1, 2, or 3 wherein the cold head includes a cold end located above the liquid nitrogen bath.

6. The cryostatic temperature regulator of claims 1, 2, or 3 wherein the cover includes a flange floor and a cap, and the cold head is positioned within the through-flange floor.

7. The cryostatic temperature regulator of claims 1, 2, or 3 wherein the position of the cold head within the container is adjustable.

8. The cryostatic temperature regulator of claims 1, 2, or 3 wherein the cold head operates according to a Gifford/McMahon principle.

9. The cryostatic temperature regulator of claim 8 wherein a gas control means is located outside the cryostatic temperature regulator.

10. The cryostatic temperature regulator of claims 1, 2, or 3 wherein the cold head includes surface enlargement means.

11. The cryostatic temperature regulator of claim 10 wherein the surface enlargement means is preferably constructed from a material chosen from the group consisting of extruded aluminum and copper.

12. The cryostatic temperature regulator of claim 3 wherein a plurality of connector nozzles are attached to the hose section.

13. The cryostatic temperature regulator of claim 3 wherein a plurality of connector nozzles are attached to the hose section and the cryostatic temperature regulator.

14. A cryostatic temperature regulator comprising:
a container for containing a liquid nitrogen bath;
a cover for covering the container;

a cold head, coupled to the cover; means for adjusting the position of the cold head with respect to a surface of the liquid nitrogen; and a heater located in a region of a cold end of the cold head.

15. The cryostatic temperature regulator of claim 14 wherein the cold head includes a cold end that is immersed in the liquid nitrogen bath.

16. The cryostatic temperature regulator of claim 14 wherein the cold head includes a cold end located above the liquid nitrogen bath.

17. The cryostatic temperature regulator of claim 16 wherein the cold head includes surface enlargement means.

18. The cryostatic temperature regulator of claim 14 wherein the means for adjusting the position of the cold head is pressure dependent.

* * * * *